United States Patent [19]

Arneson

[11] Patent Number: 4,645,463

[45] Date of Patent: Feb. 24, 1987

[54] MARINE OUTDRIVE APPARATUS

[76] Inventor: Howard M. Arneson, 6 Locksley La., San Rafael, Calif. 94901

[21] Appl. No.: 757,043

[22] Filed: Jul. 19, 1985

Related U.S. Application Data

[63] Continuation of Ser. No. 712,337, Mar. 14, 1985, Pat. No. 4,544,362, which is a continuation of Ser. No. 359,007, Mar. 17, 1982, abandoned, which is a continuation-in-part of Ser. No. 137,797, Apr. 7, 1980, abandoned.

[51] Int. Cl.[4] ..... B63H 5/12

[52] U.S. Cl. ..... 440/57

[58] Field of Search ..... 440/49, 51, 53, 55, 440/57, 61, 62, 63, 66, 75, 112; 92/165 R, 165 PR; 464/144, 906

[56] References Cited

U.S. PATENT DOCUMENTS

| | | | |
|---|---|---|---|
| 43,522 | 7/1864 | Phelps | 440/57 |
| 1,263,052 | 4/1918 | Fowler | 440/75 |
| 1,538,802 | 5/1925 | Harley | 440/63 |
| 1,697,101 | 1/1929 | Barker | 440/49 |
| 1,916,442 | 7/1933 | Rzeppa | 464/906 |
| 2,096,223 | 10/1937 | Chandler et al. | 440/63 |
| 2,370,212 | 2/1945 | Van Gorden | 440/53 |
| 2,415,183 | 2/1947 | Law | 440/63 |
| 2,475,115 | 7/19[illegible] | Van Eaton | 440/75 |
| 2,552,549 | 5/1951 | Good | 92/165 PR |
| 2,755,766 | 7/1956 | Wanzer | 440/61 |
| 2,856,883 | 10/1958 | Baker | 440/53 |
| 3,057,320 | 10/1962 | Daniels | 440/62 |
| 3,202,125 | 8/1965 | Morse | 440/62 |
| 3,433,195 | 3/1969 | Poole | 440/66 |
| 3,888,203 | 6/1975 | Lohse | 440/61 |
| 3,933,116 | 1/1976 | Adams et al. | 440/61 |
| 3,976,027 | 8/1976 | Jones | 440/61 |
| 3,980,035 | 9/1976 | Johansson | 440/66 |
| 4,056,074 | 11/1977 | Sachs | 114/280 |

FOREIGN PATENT DOCUMENTS

| | | | |
|---|---|---|---|
| 1193386 | 5/1965 | Fed. Rep. of Germany | 440/66 |
| 374696 | 6/1907 | France | 114/126 |
| 1024705 | 4/1953 | France | 440/66 |
| 574918 | 1/1946 | United Kingdom | 440/49 |
| 595684 | 12/1947 | United Kingdom | 440/4 |
| 1044931 | 10/1966 | United Kingdom | 440/49 |
| 1524184 | 9/1978 | United Kingdom | 440/75 |
| 2092974 | 8/1982 | United Kingdom | 440/61 |

*Primary Examiner*—Trygve M. Blix
*Assistant Examiner*—Jesûs D. Sotelo
*Attorney, Agent, or Firm*—Townsend and Townsend

[57] ABSTRACT

A marine outdrive attachable to the transom of a boat having an inboard engine. The marine outdrive includes a tubular support casing securable to and extendable rearwardly of the boat's transom and having a ball socket at its rear end. The ball socket receives a ball at the front end of a tubular, propeller shaft carrier having a conical outer surface. A drive shaft connectable to the inboard engine is journalled in the support casing. A propeller shaft is journalled in the propeller shaft carrier and has a propeller mounted thereon at the rear end of the propeller shaft carrier. A universal joint couples the two shafts together, the center of such joint substantially coinciding with the point about which the ball pivots within the socket. Hydraulic steering cylinders are attached to the propeller shaft carrier to pivot the latter about a steering axis extending through the pivot point of the ball. A hydraulic trim cylinder extends between the transom and the propeller shaft carrier to swing the propeller shaft carrier about a laterally extending trim axis extending through the pivot point of the ball. The upper end of the trim cylinder is pivotally mounted on the transom at a location above and vertically aligned with the pivot point of the ball or at a location above and forwardly of such pivot point. Improved fins are provided on the propeller shaft carrier near the propeller to stabilize the boat. The drive shaft of the inboard motor can be directly connected to the joint or offset from the joint and coupled thereto by a vertically extending transmission.

49 Claims, 30 Drawing Figures

MARINE OUTDRIVE APPARATUS

This is a continuation of application Ser. No. 712,337, filed Mar. 14, 1985, now U.S. Pat. No. 4,544,362, which was a continuation of application Ser. No. 359,007, filed Mar. 17, 1982, now abandoned, which was a continuation-in-part of application Ser. No. 137,797, filed Apr. 7, 1980, now abandoned.

The present invention relates generally to marine drives and more particularly to a marine inboard-outboard drive for a marine engine positioned within the boat to which the drive is mounted.

BACKGROUND OF THE INVENTION

So-called inboard-outboard drives for boats have been in use for many years. Examples of such drives are shown in U.S. Pat. Nos. 1,798,596, 2,415,813, 2,755,766, 2,977,923, 3,088,296, 3,382,838, 3,888,203, 3,893,407, 3,933,116 and 3,951,096. These inboard-ouboard drives are used in propelling boats generally having large inboard engines. A first type of drive, the type shown in all of the above patents, except for the type of drive shown in U.S. Pat. Nos. 2,415,183 and 3,933,116, has a drive shaft extending through the transom of a boat and connected by gears to a generally vertically extending shaft which in turn is connected by gears to the propeller shaft. A second type of drive, the type shown in U.S. Pat. Nos. 2,415,183 and 3,933,116, has a drive shaft which extends through the transom of a boat and connects directly to a propeller shaft without using a vertical shaft as in the other patents. For example, the propeller supporting member of the first type of drive can be rotatably lifted when the boat is in shallow water or for inspection and maintenance of the propeller and its shaft. An advantage of a drive of the first type is that the trim of the boat may be adjusted by rotating the propeller supporting member about a horizontal axis. In addition to the tilting feature, the drive is rotatable about a generally vertical axis to steer the boat. A common arrangement provides a universal joint about which the propeller supporting member of the drive of the first type can be both tilted and steered, as for example the arrangement shown in aforementioned U.S. Pat. No. 3,088,296.

Although conventional inboard-outboard drives of the first type mentioned above have some advantages and have been commercially successful to some extent, they also have disadvantages. For example, such drives are relatively heavy, expensive to manufacture and maintain, and are inefficient in transferring power from the engine to the propeller. A power loss of as much as 17% can occur because of transfer losses through the gears and couplings as compared to power losses with a direct drive. Moreover, since the propeller supporting member of such drives generally extends a considerable distance below the surface of the water, such drives have appreciable drag.

To overcome some disadvantages of conventional inboard-outboard drives of the first type, the second type of drive mentioned above has been developed. Such a drive eliminates the generally vertical shaft of the first type and couples the drive shaft directly to the propeller shaft. These direct drives, however, involve mechanisms which are too complex to be of commercial success. For example, the drive of U.S. Pat. No. 3,933,116 uses a surface piercing propeller keyed to a propeller shaft that is moved by the articulation of a gimbal assembly about a horizontal axis for steering and about a vertical axis to trim the boat. The gimbal assembly gives only limited control of the propeller shaft because the rings of the gimbal assembly are constrained to move about respective, fixed, mutually perpendicular axes. The design of this drive also requires the drive shaft to be disposed at an appreciable distance above the bottom of the transom of a boat. Thus, the propeller shaft must assume a vertically tilted position thereby pushing the bow of the boat downwardly at relatively high speeds.

The drive of U.S. Pat. No. 2,415,813 provides a ball swivel unit connected to the transom of a boat. Control of the propeller shaft of this drive is severely limited because of the location of the swivel unit and the lack of steering devices attached to the propeller shaft support.

SUMMARY OF THE INVENTION

It is a major object of the present invention to provide a marine outdrive apparatus which affords the advantages of conventional inboard-outboard drives of the types described, but eliminates the disadvantages thereof.

A marine outdrive apparatus of the present invention does not use a propeller supporting member which extends an appreciable distance below the surface of the water. Instead, such apparatus is a direct drive unit particularly adapted to provide a surface-piercing propeller although it is not limited to use with a surface-piercing propeller. In the present invention, the propeller is affixed to the aft end of the drive with the main portion of the drive extending rearwardly from the boat's transom horizontally or rearwardly and downwardly at a slight angle to the horizontal. The drive of the present invention, because of its external configuration, offers a minimum amount of resistance as it moves through the water.

Marine outdrive apparatus of the present invention, in addition to offering minimum drag, is light in weight and easy to maintain as compared with conventional inboard-outboard marine drives described above. Such apparatus may be made from corrosion-resistant materials, such as brass or stainless steel to provide a long useful operating life for it.

The marine outdrive apparatus of the present invention additionally is highly efficient in transmitting power from the boat's inboard engine to the propeller. Also, such apparatus may be used with a pair of inboard engines and a pair of drives made in accordance with the present invention can be used at the rear of a boat in side-by-side relationship.

Marine outdrive apparatus, in one embodiment of the invention, has a tubular support casing secured to and extending rearwardly from the transom of a boat. The casing is provided with a ball socket at a location spaced rearwardly from the transom, a tubular propeller shaft carrier formed at its front end with a ball that is universally pivotally carried by the ball socket, a drive shaft journalled in the support casing and connected to the boat's inboard engine, and a propeller shaft journalled in the propeller shaft carrier, the aft end of such propeller shaft being keyed to a propeller and with the shafts extending generally longitudinally of each other. Universal joint means couples the shafts together, the center of the universal joint means coinciding with the pivot point about which the ball pivots relative to the ball socket. This arrangement permits the propeller shaft carrier to swing laterally relative to the support casing about a steering axis that extends through the pivot point of the ball and also permits the propeller shaft carrier to be trimmed relative to the support casing about a generally laterally extending trim axis that extends through the same pivot point. The support casing and propeller shaft carrier extend rearwardly from the transom horizontally or at a small angle to the horizontal.

Marine outdrive apparatus of the present invention also lends itself to the use of a pair of hydraulic steering cylinders and a hydraulic trim cylinder for providing precise steering and for effecting trimming of the boat while the boat is underway. These steering and trim cylinders are operatively connected to the propeller shaft carrier in such a manner as to reduce the twisting effect of the propeller torque. By pivotally mounting the upper end of the trim cylinder on the transom at a location above and vertically aligned with the pivot point of the ball, lateral movements of the propeller shaft carrier under the influence of the steering cylinders causes the propeller shaft carrier to move in a generally horizontal plane. Thus, the propeller stops substantially the same level relative to the surface of the water as the propeller shaft carrier moves laterally. By pivotally mounting the upper end of the trim cylinder on the transom at a location above and forwardly of the pivot point of the ball, lateral movements of the propeller shaft carrier will be along an arcuate path, causing the propeller to go deeper in the water as the propeller shaft carrier moves laterally.

Another embodiment of the apparatus uses a constant speed universal joint within the ball. Also, vertical stabilizing fins are provided on the upper and lower surfaces of the propeller shaft carrier and laterally extending trim fins are provided on the lower end of the lower stabilizing fin.

These and other features will become apparent from a consideration of the following detailed description of the drawings.

Figure 2:
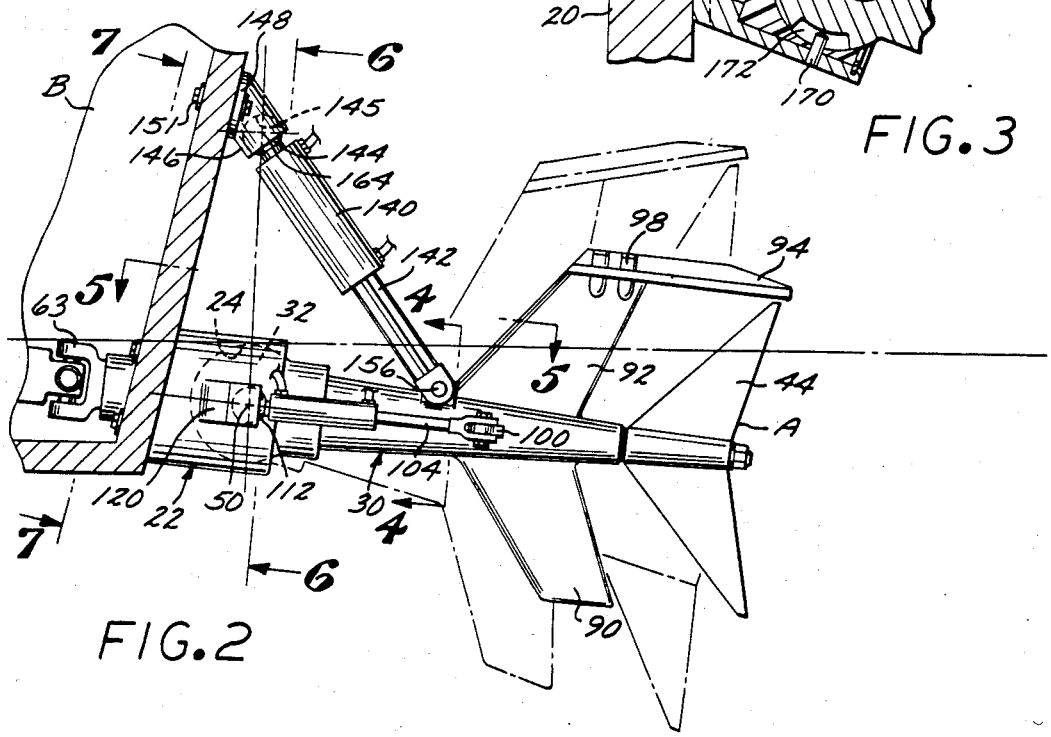
FIG. 2 is a side elevational view of the apparatus of FIG. 1.
Figure 7:
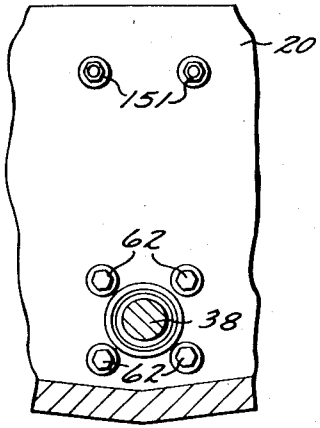
FIG. 7 is a vertical sectional view taken along line 7—7 of FIG. 2.
Figure 6:
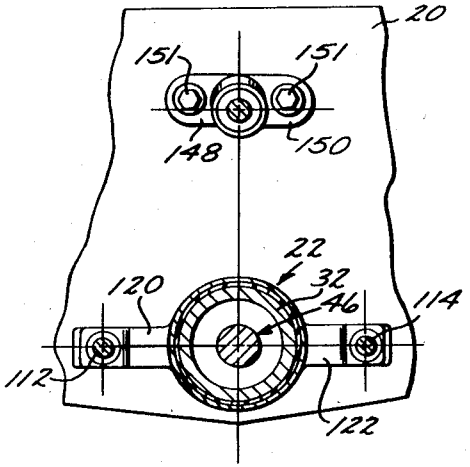
FIG. 6 is a vertical sectional view taken along line 6—6 of FIG. 2.
Figure 22:
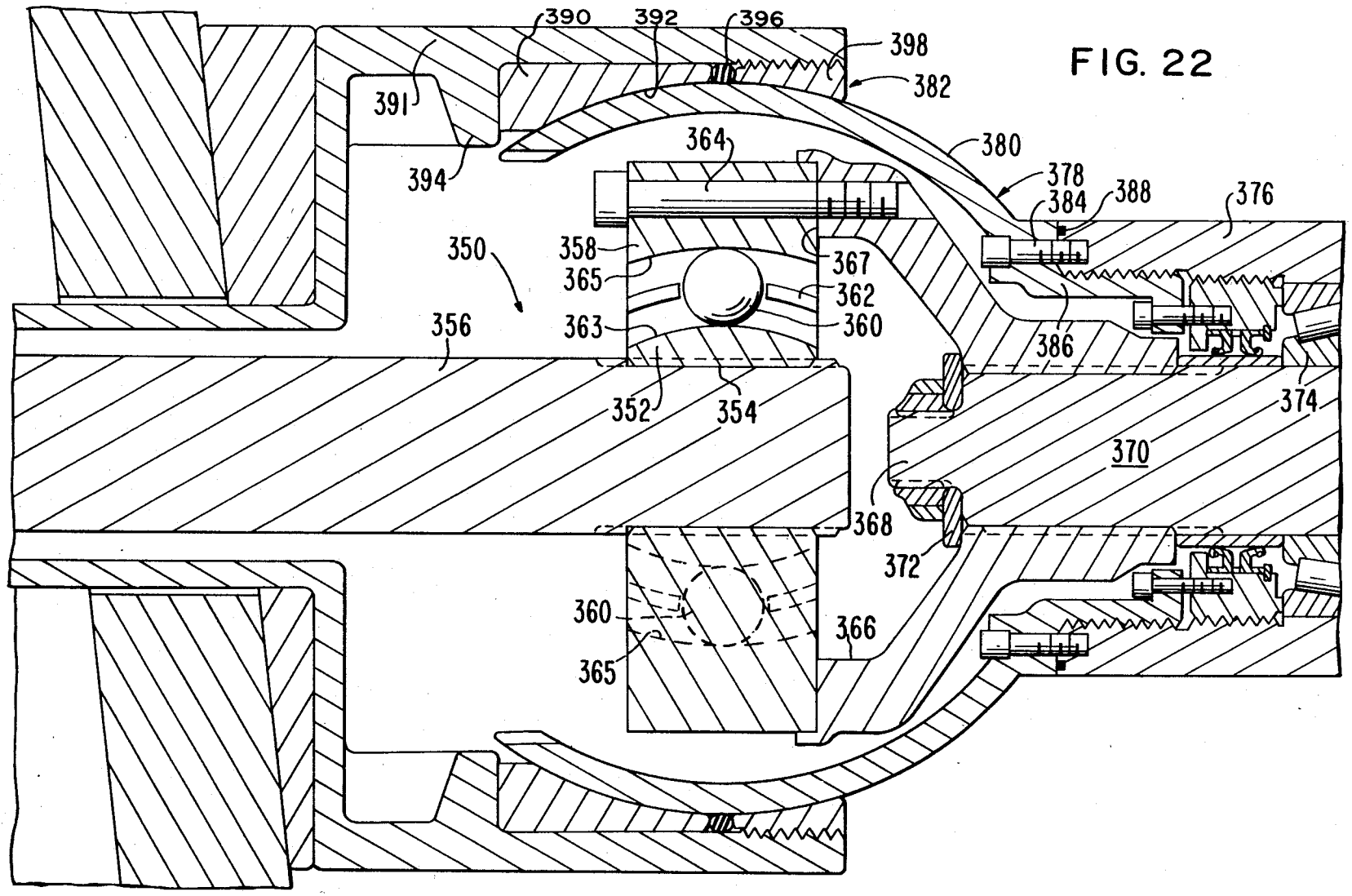
FIG. 22 is an enlarged, cross-sectional view of a universal joint of the constant velocity type for the apparatus of the present invention for interconnecting the drive and propeller shafts thereof.
Figure 25:
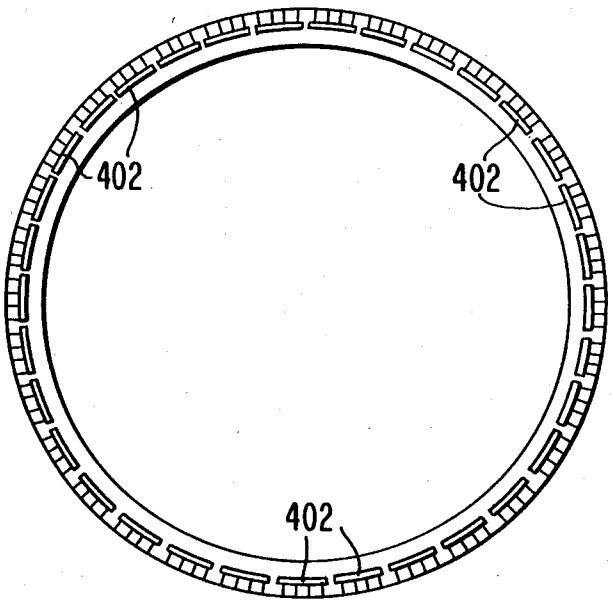
Figure 24:
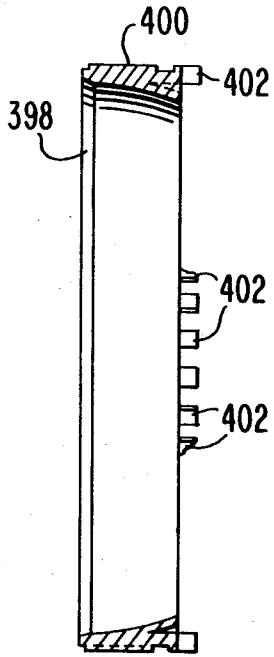
Figure 23:
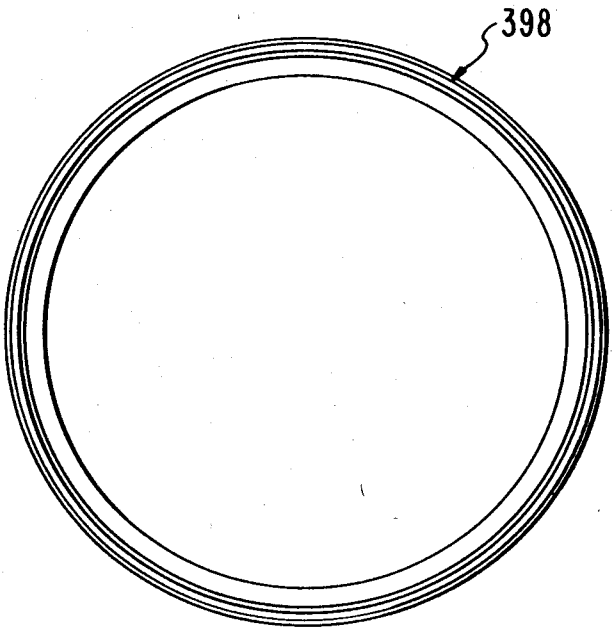
Figure 26:
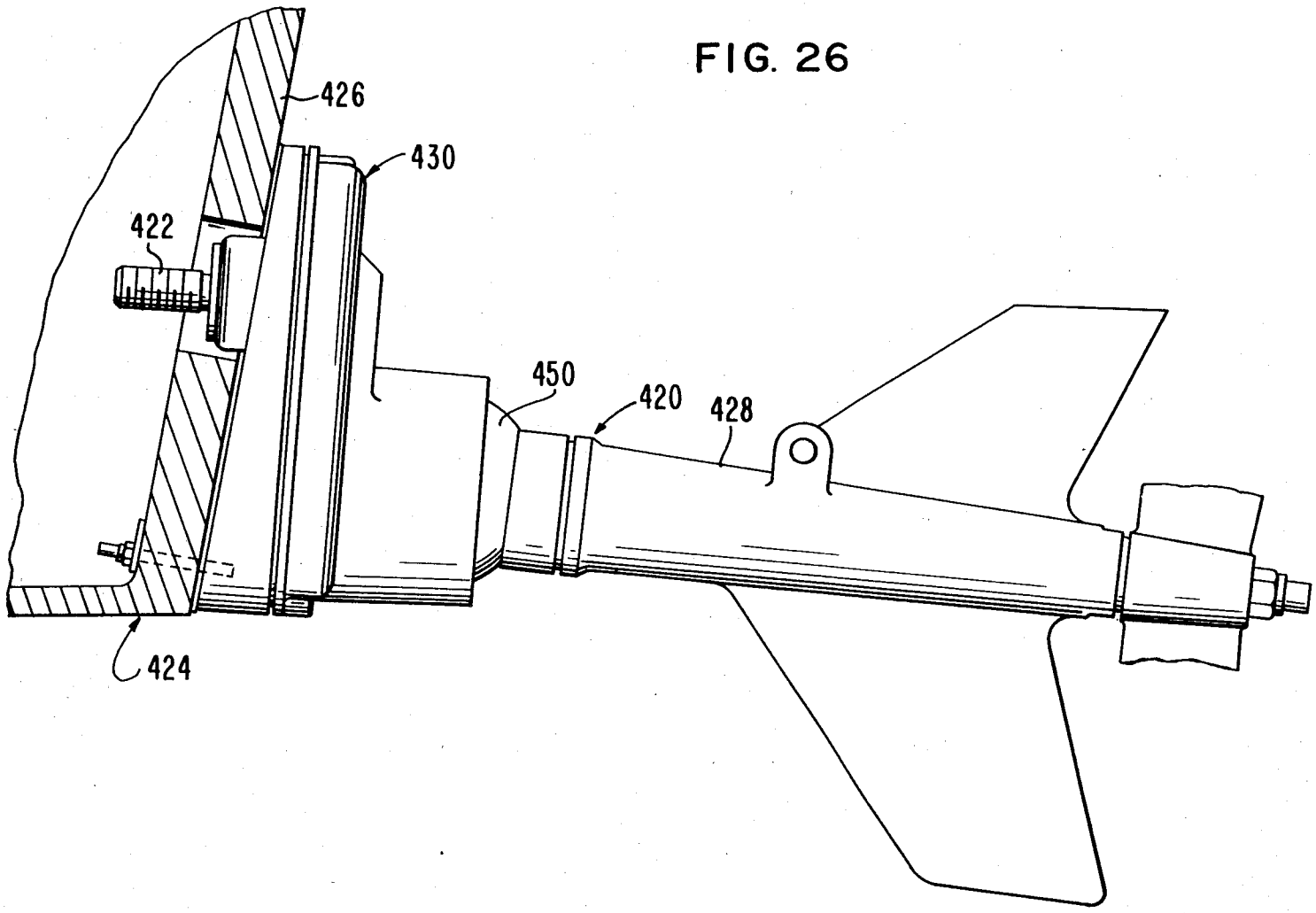
Figure 27:
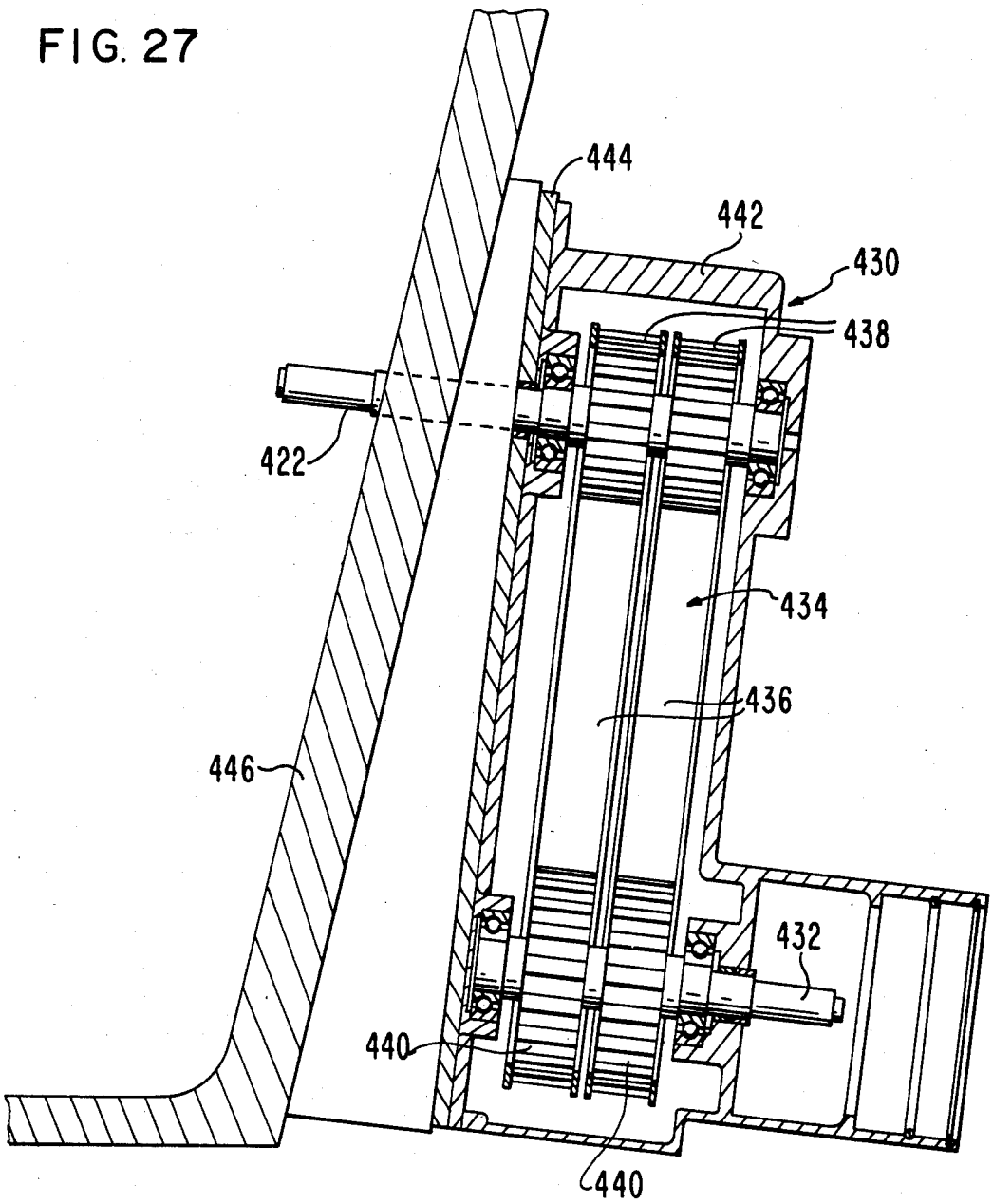
Figure 28:
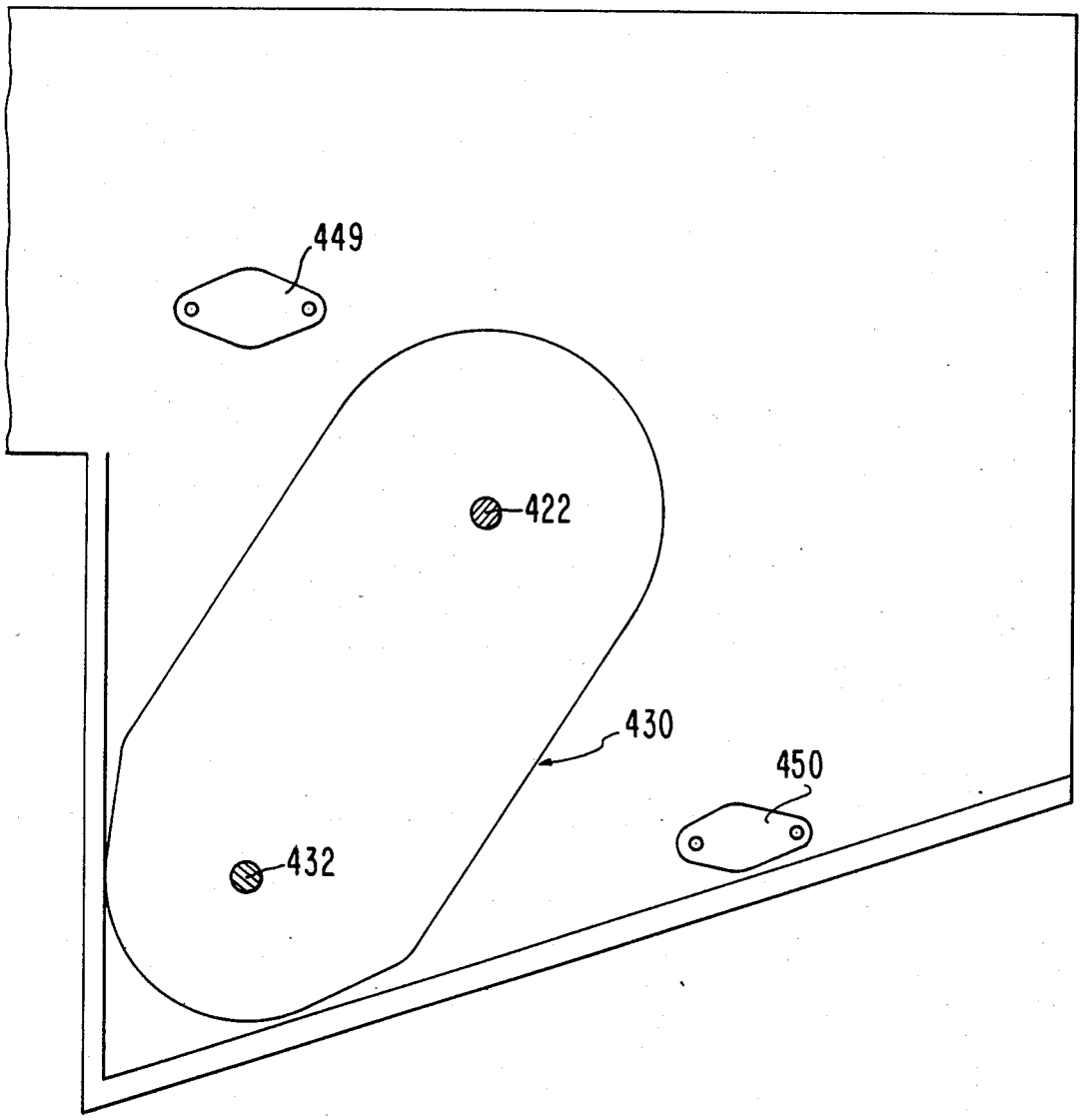
Figure 29:
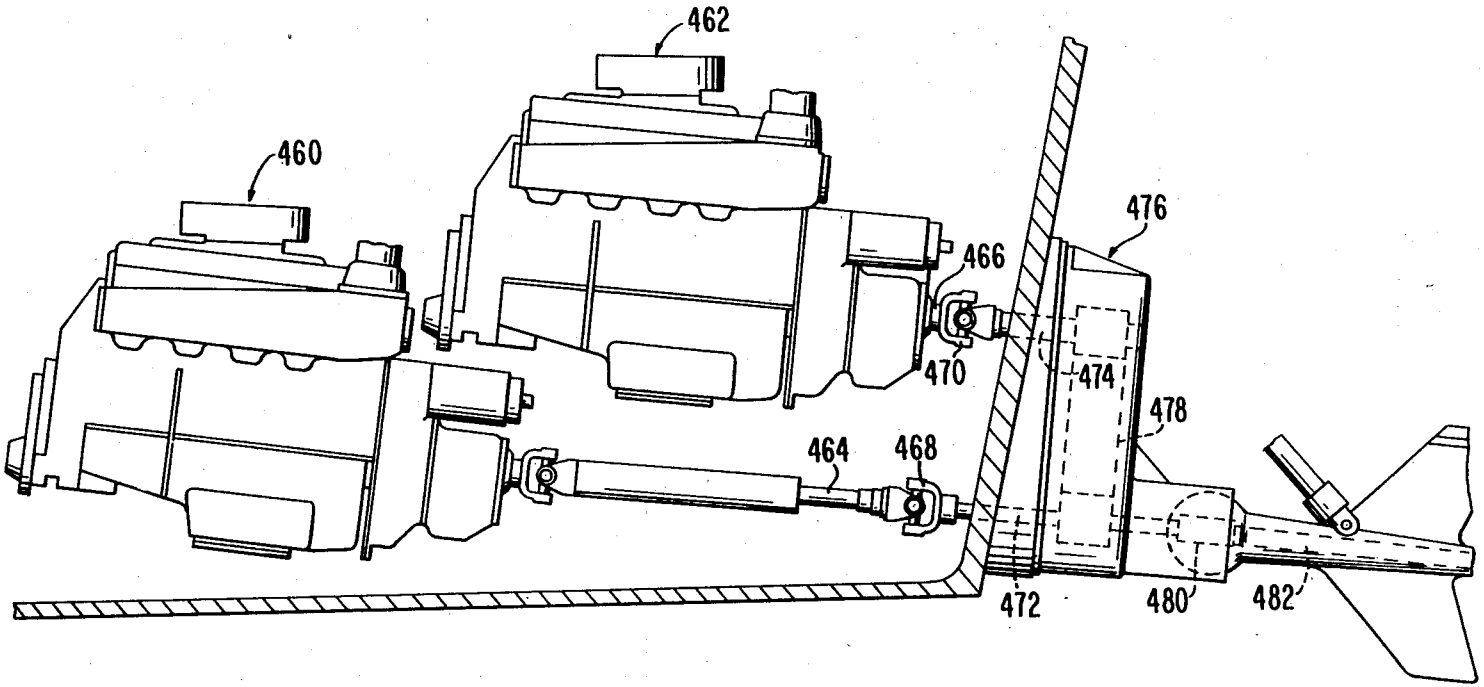

FIG. **22*a* is a front elevational view of the universal joint of FIG. 22**;

FIG. 23 is an elevational view of one end of a sealing ring for sealing the pivot ball of the apparatus of the present invention, FIG. 24 is a cross-sectional view through the ring of FIG. 23;

FIG. 25 is a view similar to FIG. 23 but showing the opposite end of the ring;

FIG. 26 is a view similar to FIG. 2 but showing the way in which the apparatus of the present invention is used with an offset drive shaft of an inboard engine in a boat;

FIG. 27 is a vertical section through the power transmission unit of the apparatus of FIG. 28;

FIG. 28 is a fragmentary rear elevational view of the transom of a boat showing an inclined transmission unit thereon for coupling the drive shaft of an inboard motor with the apparatus of the present invention; and FIG. 29 is a vertical section through a boat showing the way in which a pair of inboard motors in the boat are coupled to the propeller shaft of the apparatus of the present invention.

DESCRIPTION OF A PREFERRED EMBODIMENT

Figure 8:
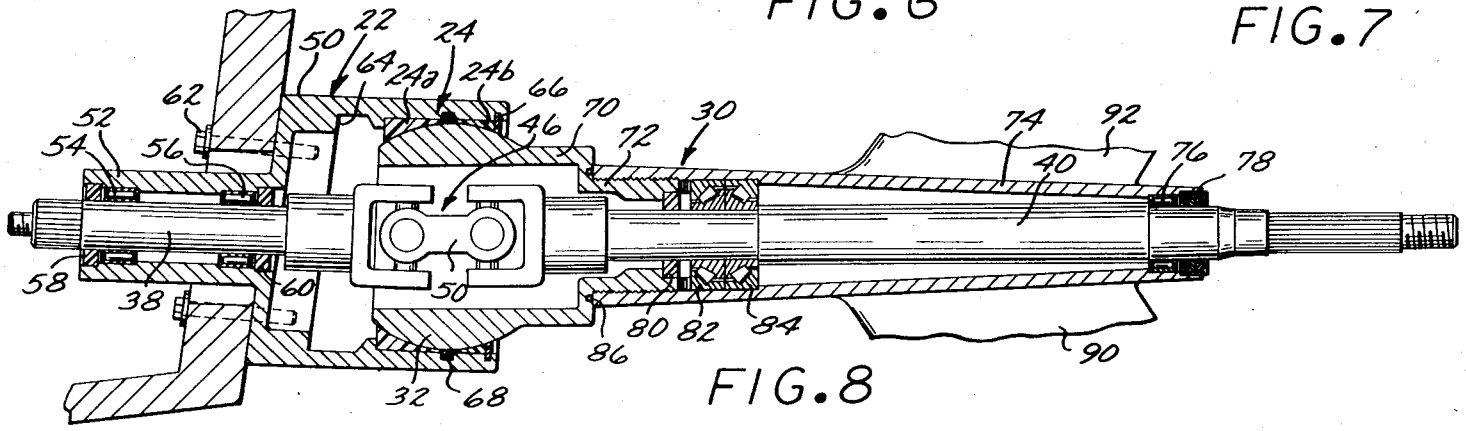
FIG. 8 is a vertical sectional view taken along line 8—8 of FIG. 1.

Referring to the drawings and particularly FIGS. 1–10 thereof, there is shown a first embodiment of marine outdrive apparatus A embodying the present invention adapted for use with a conventional boat B having a transom 20 upon which apparatus A is mounted. Apparatus A includes a tubular support casing 22 secured to transom 20 and having a ball socket 24 at its rear end. A tubular propeller shaft carrier 30 has, at its front end, a ball 32 which is universally pivotally mounted in the ball socket as shown in FIG. 8. A drive shaft 38 is journalled by bearings 54 and 56 in the support casing 22, the front end of the drive shaft connected to a single inboard engine (not shown) positioned within boat B. A propeller shaft 40 (FIG. 8) is journalled by bearings 76, 82 and 84 in propeller shaft carrier 30, with the aft end of propeller shaft 40 receiving a conventional surface-piercing propeller 44. Universal joint means 46, preferably a conventional double universal or constant speed joint, connects the rear end of drive shaft 38 to the forward end of propeller shaft 40. The center of such universal joint 46 coincides with the pivot point 50 about which ball 32 pivots relative to ball socket 24.

Support casing 22 has a main body 50 of cylindrical configuration having an open rear end. The front end of body 50 is integrally formed with a tubular boss 52 extending through transom 20. Oil seals 58 and 60 close the front and rear ends of boss 52, so as to confine a quantity of oil therewithin.

Support casing 22 is rigidly affixed to the rear surface of transom 20 by a plurality of bolts 62. The front end of drive shaft 38 may be connected to a coupling, such as a universal joint 63 (FIG. 2) forming part of a drive train directly connected to and rotated by the shaft of an inboard engine.

Ball socket 24 is preferably formed of a synthetic plastic, such as nylon, and includes front and rear rings 24*a* and 24*b* whose inner surfaces complementally engage the adjacent outer surface portions of ball 32. Front ring 24*a* abuts an annular shoulder 64 of the support casing, and rear ring 24*b* is secured in the rear end of the support casing by a snap ring 66. An O-ring 68 (FIG. 8) is between front and rear rings 24*a* and 24*b* of ball socket 24 in sealing engagement with the rings and the outer surface of ball 32.

Propeller shaft carrier 30 includes an open end housing 70. The forward portion of housing 70 is formed with ball 32 thereon. The rear portion of housing 70 is provided with an integral, externally threaded neck 72 to which is coupled the internally threaded forward end of a frusto-conical tube 74. Bearings 76, 82 and 84 are mounted in tube 34, and oil seals 78 and 80 are also provided in tube 74 immediately outboard of respective bearings. The space between oil seals 78 and 80 and surrounding propeller shaft 40 is preferably oil-filled. An O-ring seal 86 is interposed between the front end of tube 74 and the rear wall of housing 70.

A lower stabilizing fin 90 (FIGS. 1 and 2) is secured to and depends from tube 74. Fin 90 tends to keep the propeller shaft carrier from rising when the boat is in a turn. The upper margin of fin 90 is preferably cast onto such tube. An upper fin 92 of similar configuration to that of lower fin 80 extends upwardly from the tube 74 in generally vertical alignment with fin 90. The bottom margin of upper fin 92 is preferably cast onto the tube. The upper end of fin 92 supports a horizontal cavitation plate 94, the cavitation plate preferably being secured to the front portion of upper fin 92 by means of bolts 98. The rear edge of the caviation plate 94 is spaced rearwardly from fin 92 and overhangs propeller 44 to protect it against contact with a dock or the like. Such cavitation plate also contains the boat's roostertail.

Figure 5:
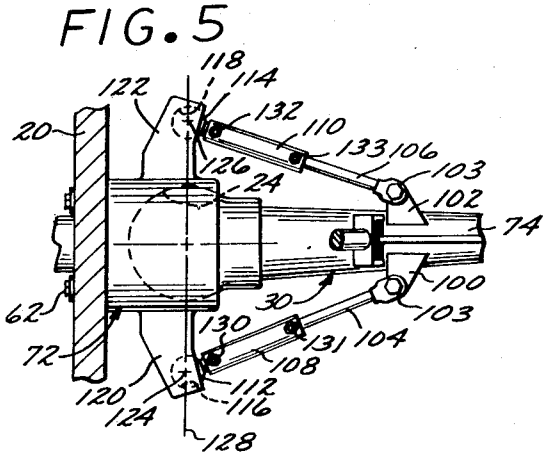
FIG. 5 is a fragmentary, top plan view of the apparatus showing the steering cylinders thereof.

The intermediate side portions of tube 74 are provided with respective, laterally extending ears 100 and 102. Such ears are pivotally connected to brackets 103 (FIG. 5) affixed to the rear ends of piston rods 104 and 106 shiftably coupled to power-operated hydraulic steering cylinders 108 and 110, respectively. The forward ends of such steering cylinders are provided with ball pivots 112 and 114, respectively, rotatably received within complimentary recesses 116 and 118 formed in a pair of mounts 120 and 122 (FIG. 5). Such mounts are preferably cast onto the midportion of opposite sides of support casing 22. In the alternative, such mounts may be secured to transom 20.

The pivot points 124 and 126 (FIG. 5) about which spheres 112 and 114 rotate relative to their sockets 116 and 18, are disposed upon a horizontal line 128 (FIGS. 5 and 9) extending through the aforementioned pivot point 50 about which ball 32 rotates relative to its socket 24. Line 128 is normal to the longitudinal axis of drive shaft 38.

Figure 10:
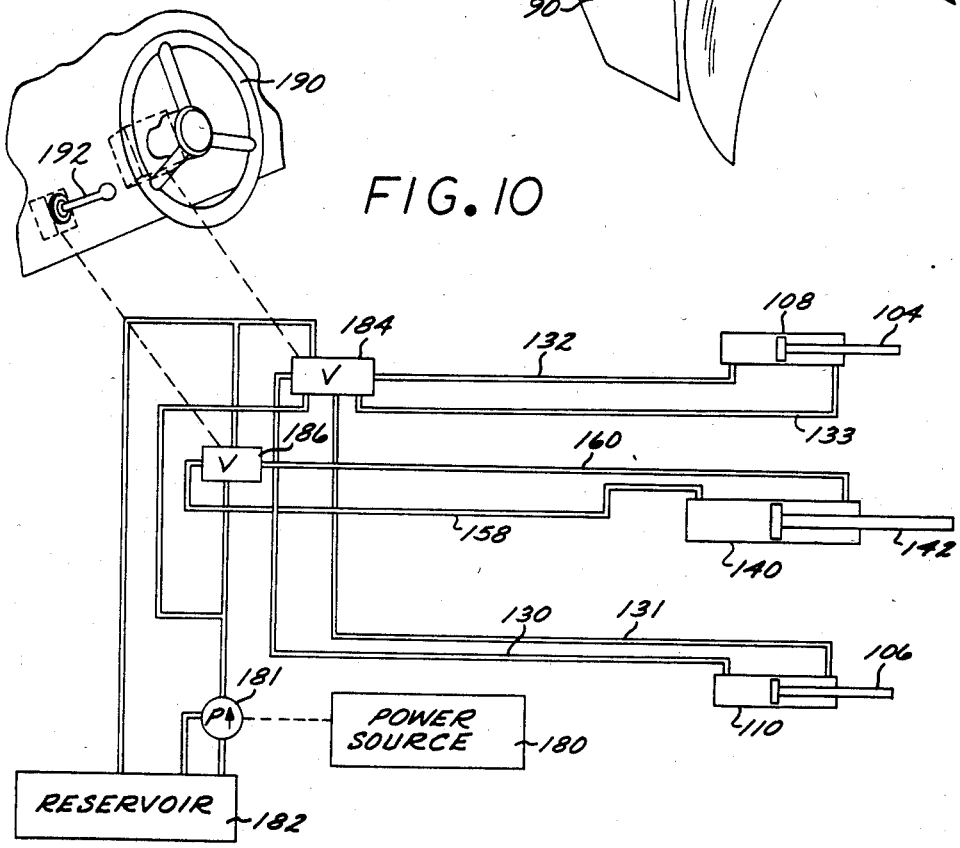
FIG. 10 is a schematic view of the steering and trim control system for the apparatus.

The front and rear portions of steering cylinders 108 and 110 are provided with fluid conduits 130, 131, 132 and 133 (FIG. 1) in communication with conventional hydraulic steering system shown in FIG. 10. The operation of this system will be described hereafter.

Figure 1:
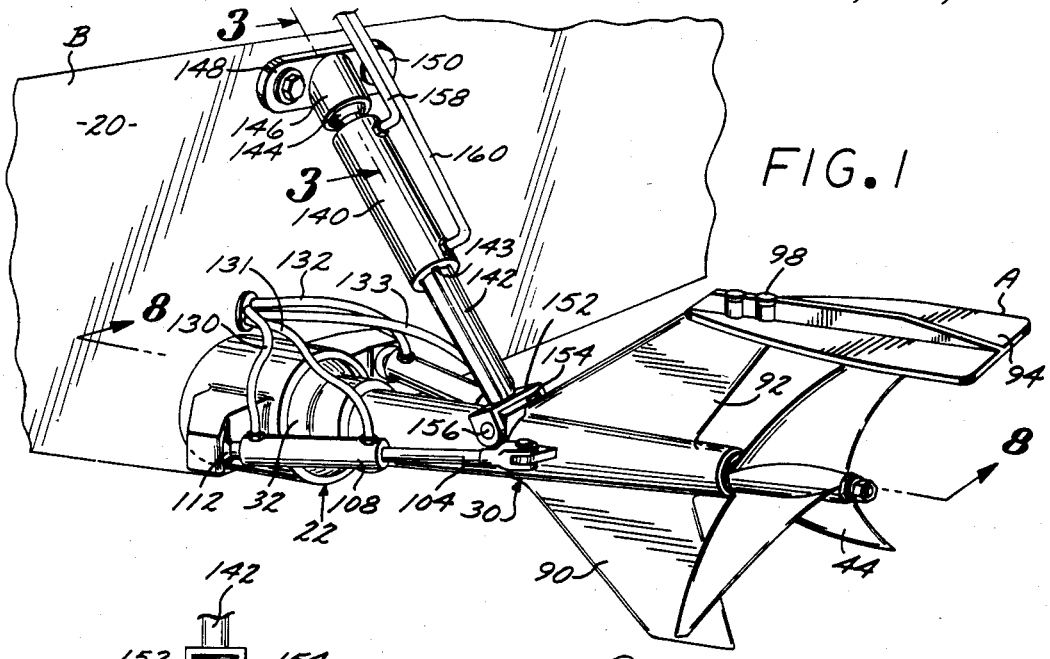
FIG. 1 is a perspective view of a first embodiment of marine outdrive apparatus of the present invention.
Figure 4:
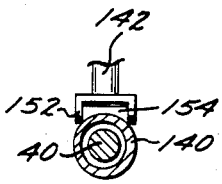
FIG. 4 is an enlarged vertical sectional view taken along line 4—4 of FIG. 2.
Figure 9:
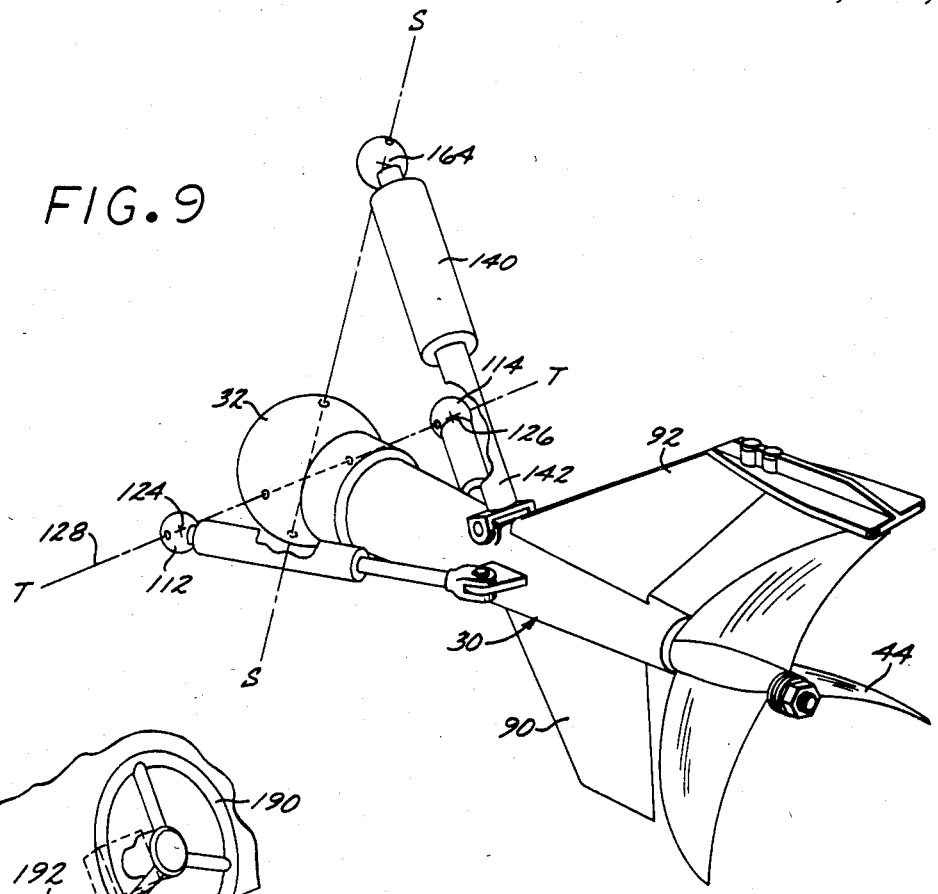
FIG. 9 is a schematic view of the apparatus showing the spatial relationship between the steering axis and trim axis thereof.

A hydraulic trim cylinder 140 having a piston rod 142 extends between the boat's transom 20 and the propeller shaft carrier 30 as shown in FIGS. 1, 2, and 9. Rod 142 is locked against rotation relative to trim cylinder 140 as by complementary splines and grooves indicated at 143 in FIG. 1. The front end of the cylinder 140 is provided with a ball pivot 144 pivotally received within a socket 145 of a mount secured to transom 20 by fasteners 151. The rear end of rod 142 is provided with a bifurcated bracket 152 which straddles an upwardly extending pad 154 (FIG. 1) rigidly affixed to the upper, intermediate portion of tube 74 near the lower front end of fin 92. A pivot pin 156 interconnects bracket 152 and pad 154. Hydraulic conduits 158 and 160 (FIG. 1) connect the front and rear ends of trim cylinder 40 with the hydraulic system shown in FIG. 10.

Figure 3:
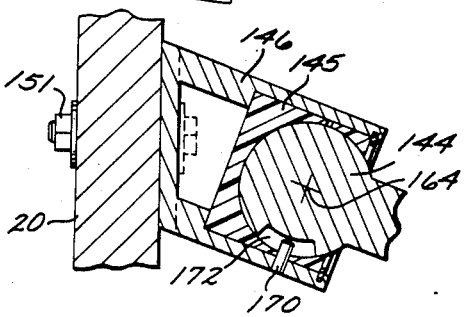
FIG. 3 is an enlarged vertical sectional view taken along line 3—3 of FIG. 1.

Referring to FIG. 3, socket 145, trim cylinder 40, and rod 142 are shown as being locked against rotation relative to mount 146. To this end, an upright pin 170 is received within an arcuate slot 172 on the underside of ball pivot 144 in a vertical plane therethrough. Pin 170 limits the pivotal movement of ball pivot 144 to an acute angle in a vertical plane.

The hydraulic system of FIG. 10 includes a conventional power source 180, such as a conventional electric motor coupled to a hydraulic pump 181. A reservoir 182, conventional control valves 184 and 186 are coupled to pump 181. Steering cylinders 108 and 110 and trim cylinder 140 are connected to valves 184 and 186, respectively, by conduits 130, 131, 132, 133, 158 and 160. Valve 184 is operatively connected to a steering wheel 190 of the boat in a conventional manner while valve 186 is operatively connected to an up-down trim lever 192 in a conventional manner. Rotation of steering wheel 190 will operate valve 184 so as to control the flow of pressurized hydraulic fluid from pump 181 to steering cylinders 108 and 110. In this manner, piston rods 104 and 106 of the steering cylinders will be concurrently extended and retracted, respectively to swing propeller shaft carrier 30 laterally about a steering axis S—S which extends through point 50 about which ball 32 pivots relative to ball socket 24. As shown in FIG. 9, pivot point 164 of ball pivot 144 lies on steering axis S—S.

If the steering axis S—S is generally vertical, i.e., if pivot point 164 of ball pivot 144 is vertically aligned with point 50 of ball 32 as shown in FIG. 2, the lateral movements of propeller shaft carrier 30 will be in a generally horizontal plane. Thus, propeller will not go up or down as propeller shaft carrier 30 moves from side to side. If, however, steering axis is inclined forwardly, i.e., if pivot point 164 of ball pivot 144 is forwardly of point 50 of ball 32, as shown in and hereafter discussed with reference to FIG. 13, then the lateral movements of propeller shaft carrier 30 will not be in a flat plane but along a curved path. As propeller shaft carrier 30 moves to either side, its rear end will move downwardly, thereby causing the propeller to go deeper into the water. Return of propeller shaft carrier 30 to its central operating position (FIG. 5) causes the propeller to rise to its normal position in the water. Thus, when the boat is in turns, the drive apparatus of the present invention will provide for greater thrust when steering axis is inclined forwardly because the propeller is then deeper in the water.

Movement of the up-down trim lever 192 (FIG. 10) will effect operation of valve 186 to control the flow of pressurized hydraulic fluid into the opposite ends of trim cylinder 140. This causes extension or retraction of rod 142 relative to trim cylinder 140, thereby swinging the propeller shaft carrier 30 about a trim axis T—T (FIG. 9) extending through the aforementioned pivot point 50 and coinciding with aforementioned line 128. The non-rotatable connection (FIG. 3) between the trim cylinder sphere 144 and housing 146 and between the trim cylinder 140 and its rod 42 serves to resist twisting forces applied to the propeller shaft carrier 30 upon rotation of propeller 44. Similarly, the positioning of the steering cylinders and rods in a plane through the center of propeller shaft carrier 30 also resists such twisting forces.

The compact construction of ball 32 and ball socket 14 permits support casing 22 to be secured at the lower portion of boat transom 20. Accordingly, the propeller shaft 40 may be maintained in close longitudinal alignment with drive shaft 38 during normal forward travel of boat B. The line of propeller thrust is thereby maintained low relative to the boat and below the boat's center of gravity. Maximum efficiency with respect to the transmission of torque is thereby obtained. Also, drive shaft 38 may be coupled to any conventional power transfer means (not shown) and, the engine may be mounted at any convenient position in the boat, including an amidships position or a position just forwardly of the transom through the use of a conventonal transmission (not shown).

Figure 11:
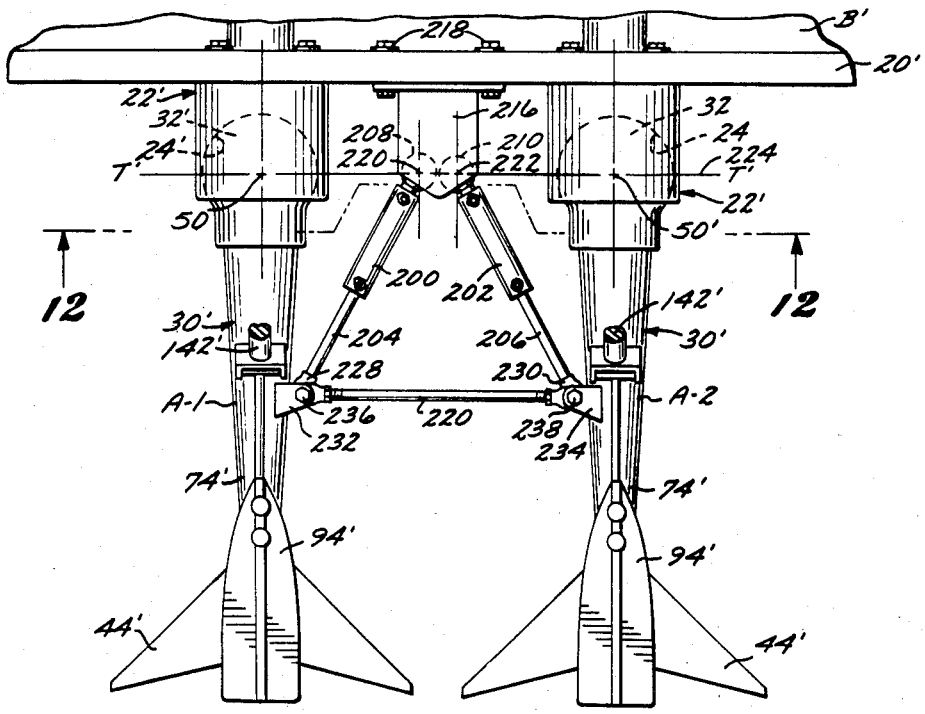
FIG. 11 is a top plan view of an embodiment of marine outdrive apparatus of the present invention using a pair of propeller shaft carriers.
Figure 12:
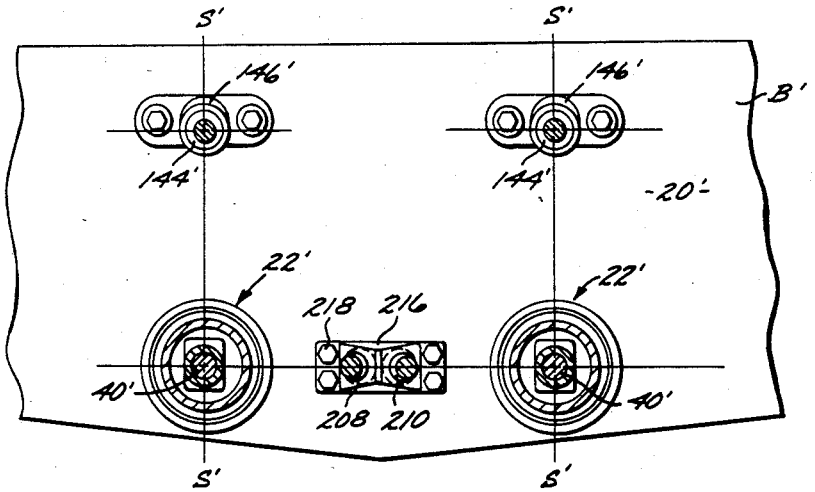
FIG. 12 is a vertical sectional view taken along line 12—12 of FIG. 11.

The teachings of the present invention can be employed with a pair of inboard engines (not shown), mounted within the boat B (FIGS. 11 and 12). In such a case, a pair of marine outdrives A-1 and A-2, substantially identical to the aforedescribed marine outdrive apparatus A, are coupled with respective inboard engines. Accordingly, parts in FIGS. 11 and 12 which correspond to parts in FIGS. 1–10 bear primed reference numerals.

The marine outdrive apparatus of FIGS. 11 and 12 uses a different steering cylinder arrangement than that employed with the embodiment of FIGS. 1–10. This arrangement includes right and left hydraulic steering cylinders 200 and 202 having piston rods 204 and 206. The forward ends of these steering cylinders are, respectively, secured to ball pivots 208 and 210. Such spheres are rotatably positioned within sockets formed in the rear portion of a mount 216 secured to boat transom 20' by fasteners 218. Points 220 and 222 about which ball pivots 208 and 210 rotate relative to their sockets are on a generally horizontal line 224 that is normal to the longitudinal axes of the drive shafts of the marine outdrives A-1 and A-2. Line 224 extends through pivot points 50' about which the balls 32' pivot relative to their sockets 24'. Line 224 coincides with the trim axes T'—T' of the propeller shaft carriers 30'.

The rear ends of piston rods 204 and 206 are affixed to ears 228 and 230 pivotally attached to brackets 232 and 234 on respective propeller shaft carriers 30' by pins 236 and 238. These brackets are preferably cast onto the inner surfaces of the intermediate portions of carriers 30'. A tie rod, 220 (FIG. 11) has its opposite ends secured to brackets 232 and 234 by pins 236 and 238. The front ends of steering cylinders 200 and 202 are provided with hydraulic conduits in communication with a conventional control system (not shown) that effects concurrent extension and retraction of plungers 204 and 206 to thereby swing propeller shaft carriers 30' about a pair of steering axes S'—S' which extends through trim axis T'—T' and pivot points 50'.

Propeller shaft carriers 30' are each provided with trim cylinders (not shown) identical to those described above for swinging such carriers about trim axis T'—T'. As indicated in FIG. 12, the pivot points about which trim cylinder spheres 144' rotate relative to their sockets 145' are located on the steering axes S'—S'.

The operation of the twin engine marine outdrive apparatus of FIGS. 11 and 12 will be similar to the operation of the apparatus of FIGS. 1–10. Both embodiments of the invention provide high efficiency, minimum drag and weight, and minimum maintenance. With respect to maintenance, the propeller shaft carrier 30 may be readily replaced and installed by disconnecting the universal joint 46. Boat trim may be readily adjusted for load and wave conditions. Moreover, it is a particular advantage that maximum acceleration can be obtained by raising the propeller relative to the water's surface and increasing engine RPM into the engine's power curve by permitting the propeller to slip, and thereafter lowering the propeller toward the water as boat speed increases. This procedure is especially useful under heavy load conditions.

Figure 13:
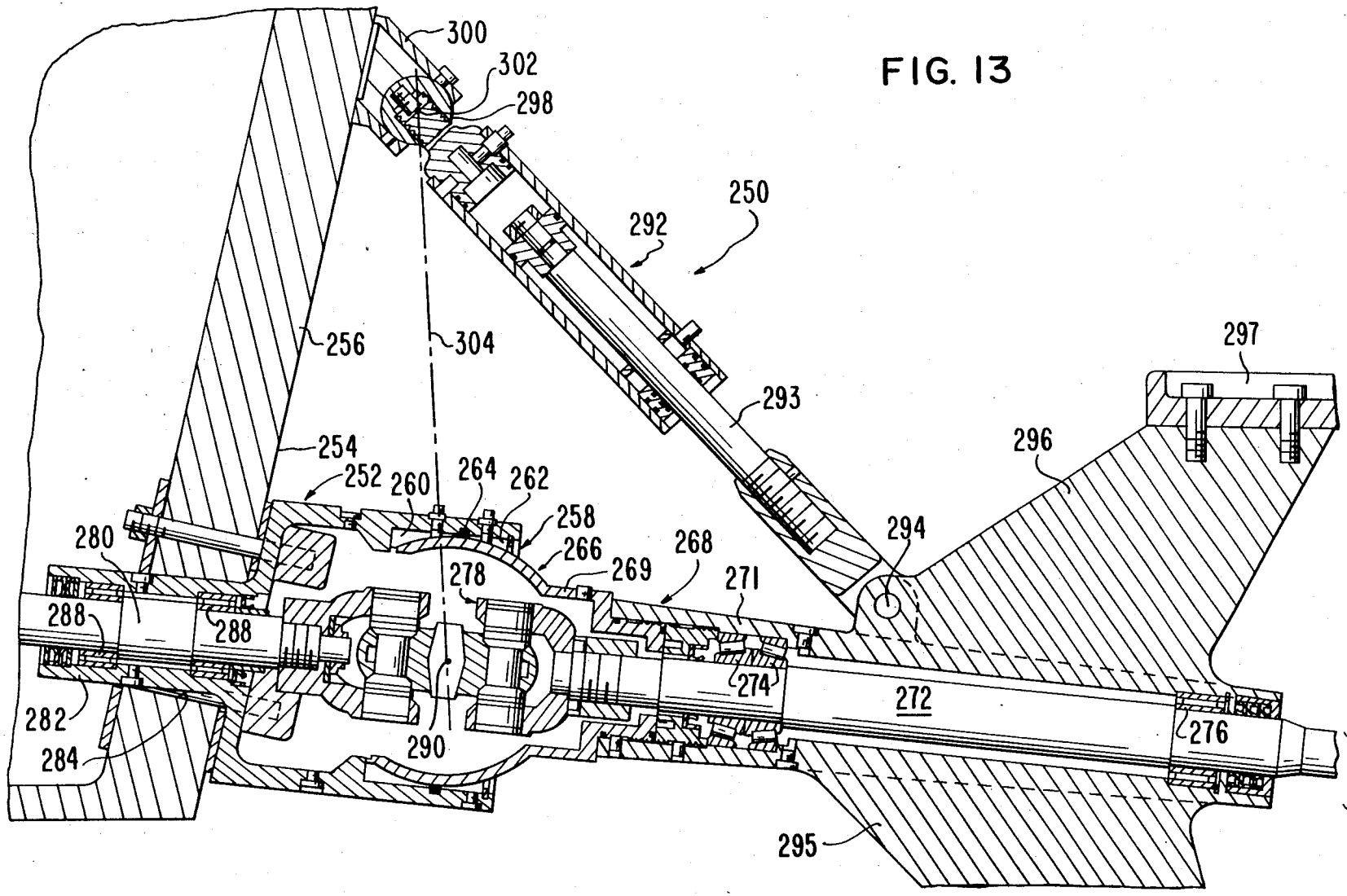
FIG. 13 is a view similar to FIG. 8 but showing a second embodiment of the apparatus of the present invention.
Figure 15:
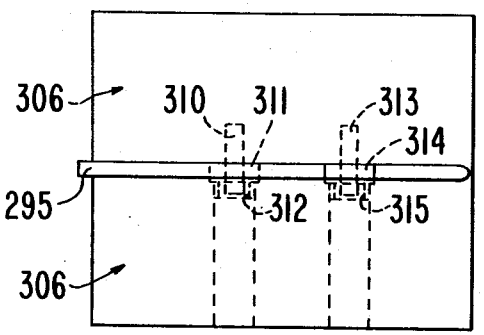
FIG. 15 is a cross-sectional view taken along line 15—15 of FIG. 14.

FIG. 13 shows another embodiment of the marine outdrive apparatus of the present invention. It is denoted by the numeral 250 and is generally of the same construction as the marine outdrive apparatus A (FIGS. 1–10) in that it has a tubular support casing 252 secured to the rear face 254 of a boat transom 256. Support casing 252 extends rearwardly of the transom and has a rear, open end provided with a socket 258 formed by a pair of nylon sealing rings 260 and 262 separated by an O-ring seal 264. The socket pivotally receives a pivot ball 266 at the forward end of a propeller shaft carrier 268 which extends rearwardly of support casing 252. Carrier 268 has a cylindrical segment 269 to which is threaded a tubular, frusto-conical segment 271 surrounding a propeller drive shaft 272 journalled in carrier 268 by bearings 274 and 276. A propeller (not shown) is mounted on the rear end of shaft 272.

A universal joint 278 interconnects the front end of propeller shaft 272 and the rear end of a drive shaft 280 of an inboard motor, shaft 280 extending through a tubular front segment 282 of support casing 252 and extending through a hole 284 in transom 256. Bearings 288 journal shaft 280 in segment 282.

Universal joint 278 has a pivot point 290 about which ball 266 can pivot. This point 290 corresponds generally with pivot point 50 described above with respect to ball 32 of apparatus of FIGS. 1–10.

A trim cylinder 292 has a piston rod 293 whose lower, outer end is coupled by pin 294 to propeller shaft carrier 268 near the front lower margin of an upper stabilizing fin 296 rigid to the rear end of carrier 268. A cavitation plate 297 is secured to the top margin of fin 296 and extends rearwardly thereof. A lower stabilizing fin 295 is secured to and extends downwardly from carrier 268.

Cylinder 292 has a ball pivot 298 at the upper end thereof and received within the socket of a mount 300 secured in any suitable manner to the rear face 254 of transom 256. The pivot point 302 of pivot 298 lies along a steering axis 304 which also passes through pivot point 290 of universal joint 278. This steering axis is inclined forwardly with respect to the vertical by a small angle of at least several degrees and, with this inclination of the steering axis, the propeller on the rear end of propeller shaft 272 will move up and down along an arcuate path as carrier 268 swings laterally relative to support casing 252 under the influence of a pair of steering cylinders of the type shown in FIG. 5 and identified as numerals 108 and 110 in FIG. 5. Thus, the propeller will go deeper into the water as the carrier 268 swings to one side or the other and the propeller will be at its highest point when the propeller shaft carrier 268 is generally longitudinally aligned with drive shaft 280. Thus, in making a turn of the boat, greater thrust will be achieved from apparatus 250 since the propeller with be lower in the water during a turn.

Figure 14:
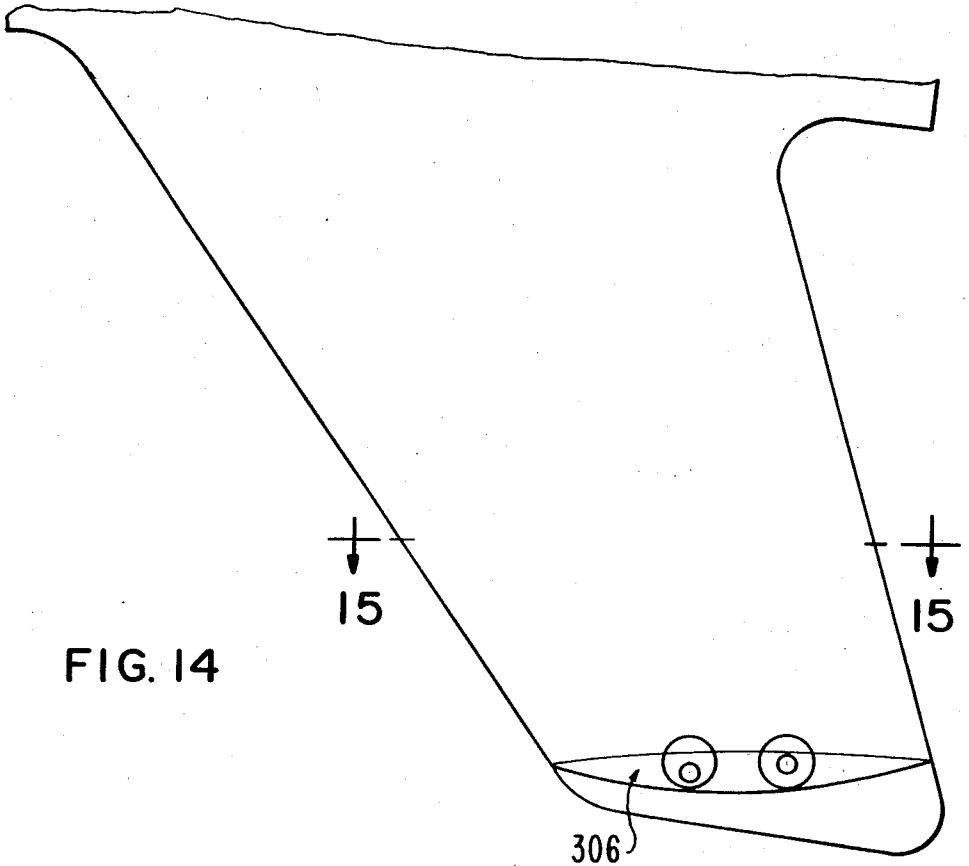
FIG. 14 is an enlarged, fragmentary, side elevational view of the the lower stabilizing fin of the apparatus of FIG. 13 showing a trim fin secured thereto near the lower margin thereof.

Trim fin means is provided on the lower margin of lower stabilizing fin 295 in the manner shown in FIG. 14. To this end, a pair of trim fins 306 are adjustably mounted on opposite sides of fin 295, the fins having a negative angle of attack by virtue of the airfoil design thereof shown in FIG. 14. Fins 306 are typically below water level about 12 inches and project laterally from fin 295 a distance sufficient to provide a net downward force on fins 306 due to the movement of such fins through the water. This downward force is provided to offset porpoising and the tendency for the stern of the boat to ride up due to propeller lift.

Fins 306 are adjustably coupled in any suitable manner to fin 295. For purposes of illustration, the fins 306 are provided with adjusting devices so that the angle of attack of each fin 306 can be adjusted to provide a predetermined force. One of the adjusting devices includes a pin 310 carried by a first trim fin 306 on one side of fin 295. Pin 310 is eccentrically mounted in a disk 311 carried in a hole in fin 295. Pin 310 then extends into a holder 312 in the other trim fin 306. Disk 311 can rotate relative to fin 295 to cause pin 310 to move up and down relative to fin 295.

Rearwardly of eccentric 308, a pin 313 is carried by the first trim fin 306 and is received at the center of a disk 314 rotatably received in a second hole in fin 295. Pin 313 then extends into a holder 315 in the other trim fin 306. By rotating disk 311 relative to fin 295 and pin 313, the angle of attack of both fins 306 can be varied. Some suitable means (not shown) for holding the eccentric in a fixed position is provided.

Figure 16:
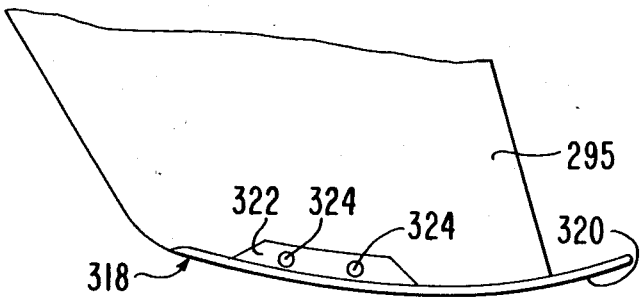
FIG. 16 is a view similar to FIG. 14 but showing another embodiment of a trim fin.

FIG. 16 shows another embodiment of a trim fin 318 for the lower margin of fin 295. Fin 318 has a curved lower surface 320 which provides a downward force exerted on fin 295 to keep the bow of the boat from rising excessively at high speeds. Fin 318 has a side flange 322 secured by fasteners 324 to fin 295. Another fin 318 is provided on the opposite side of fin 295 and the other fin will have a flange 322 secured by fasteners 324 to fin 295.

Figure 17:
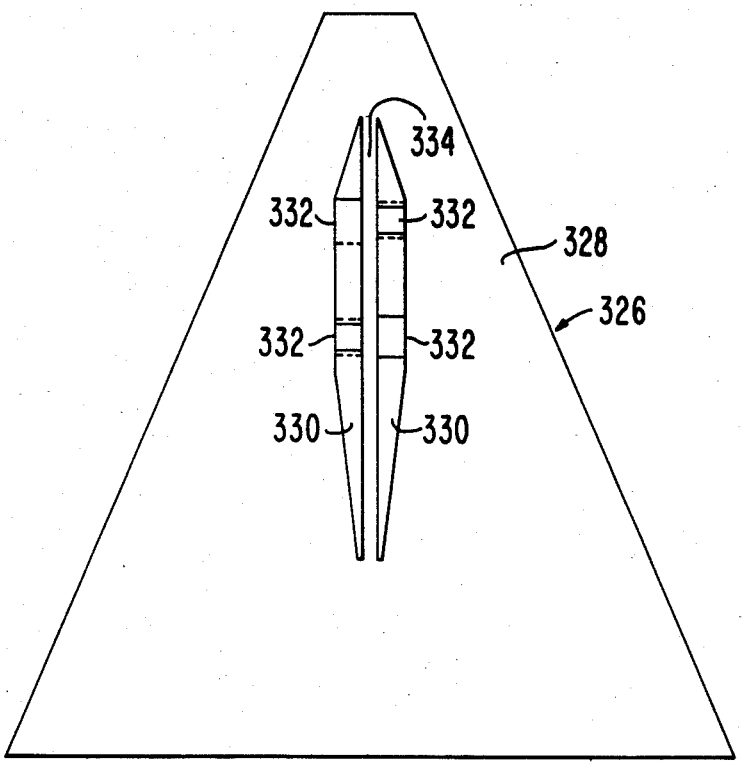
FIG. 17 is a top plan view of another embodiment of a trim fin.
Figure 18:
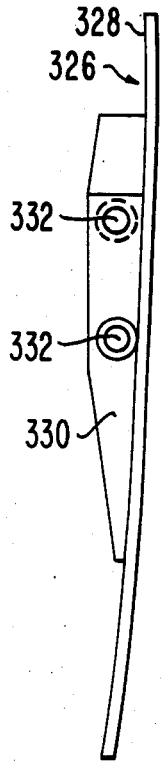
FIG. 18 is a side elevational view of the fin of FIG. 17.

FIG. 17 shows a top plan view of another embodiment of a trim fin assembly for attachment to the lower margin of fin 295. Trim fin assembly 326 is comprised of a single, delta-shaped, rigid fin 328 having a pair of spaced flanges 330 on its upper surface, the flanges having holes 332 for receiving attachment devices for securing assembly 326 to fin 295 when the lower margin of fin 295 is in the gap 334 between flanges 330. A hole 332 in each flange is adapted to receive a disk which eccentrically receives a pin carried in the other, aligned hole 332 in some suitable fashion so that the fin 328 can be adjustably mounted on fin 295. This feature permits the angle of attack of assembly 326 to be changed to vary the downward force generated by the fin moving at high speeds through the water. Fin 328, as shown in FIG. 18 has a curved lower surface to provide an airfoil effect.

Figure 19:
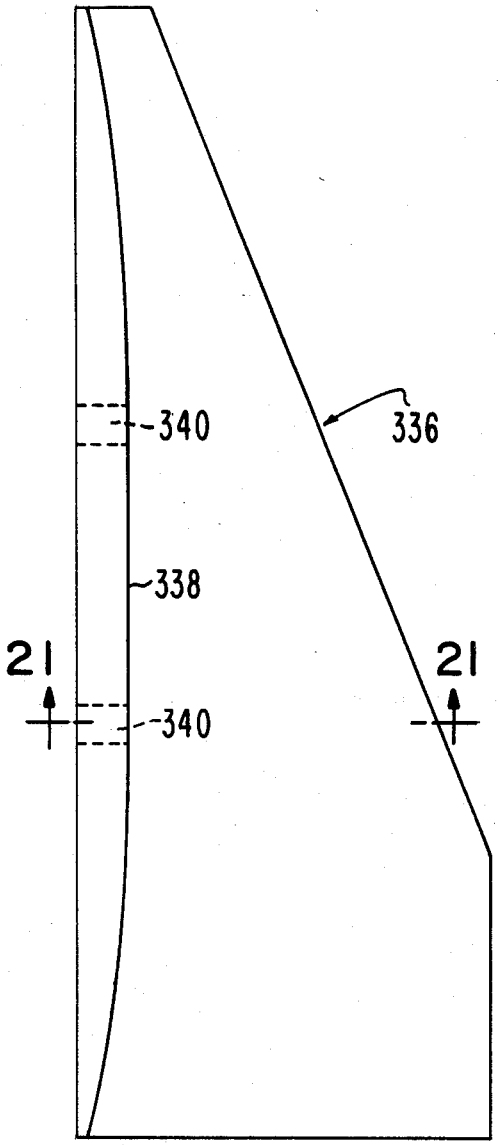
FIGS. 19 and 20 are top plan and side elevational views of another embodiment of a trim fin.
Figure 20:
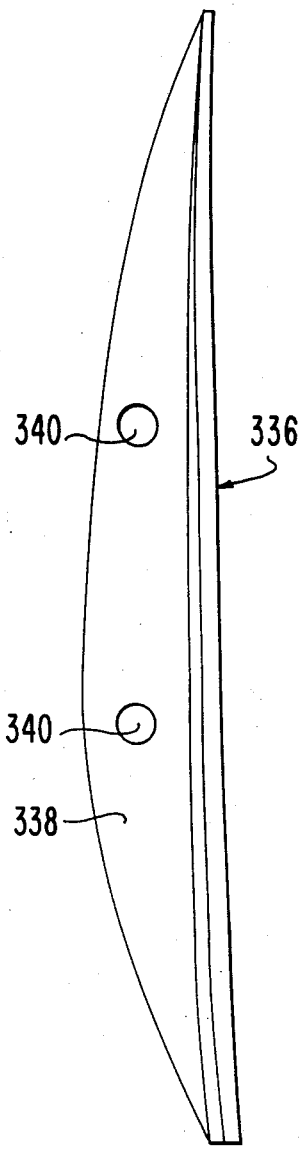
Figure 21:
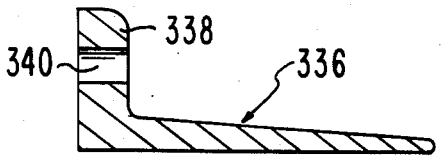
FIG. 21 is a cross-sectional view taken along line 21—21 of FIG. 19.

FIGS. 19–21 show another embodiment of a trim fin for one side of fin 295. Fin 336 has a side flange 338 for attaching fin 336 to the lower margin of fin 295. Flange 338 has holes 340 for receiving attachment devices which can be eccentrically mounted for adjustment of the angle of attack of fin 336 relative to fin 295. In FIG. 20, the curvature of the fin is shown and FIG. 21 shows the cross-section of the fin intermediate its front and rear ends, the fin being delta-shaped throughout a major part of its length as shown in FIG. 19. A corresponding fin will be provided for the opposite side of fin 295.

Figure 22A:
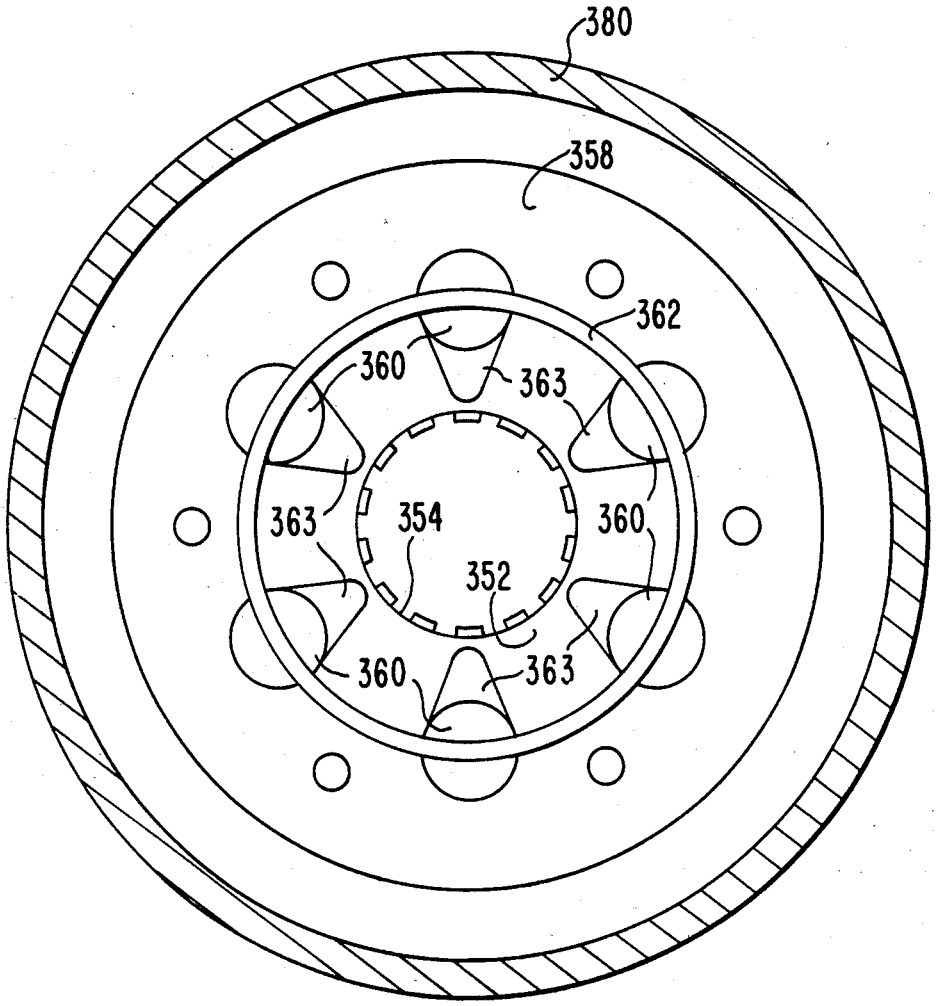

Instead of using the universal joint described above with respect to FIGS. 8 and 13, a constant velocity universal joint 350 can be used, joint 350 being shown in detail in FIGS. 22 and 22*a*. Universal joint 350 is a Rzeppa type and is adapted for carrying heavier loads for its size than other types of constant velocity joints. A universal joint of this type can be obtained from Spicer Universal Joint Division of Dana Corporation, Detroit, Mich.

Joint 350 includes an inner race 352 having a splined, central hole 354 for receiving the drive shaft 356 of an inboard motor. Joint 350 further includes an outer race 358 which is coupled by a number of circumferentially spaced balls 360 to inner race 352. A cage 362 holds the balls 360 in place and grooves 363 and 365 in inner and outer races 352 and 358, respectively, allow pivotal movement of outer race 350 universally in all directions through a given angle. Such pivotal movement can be as much as a total of 35° in substantially all directions, a pivotal action greater than that achieved by the universal joint shown in FIGS. 1–10 and FIG. 13. The pivot axis of universal joint 350 is denoted by 351 and it is also the pivot point of ball 380 in which joint 350 is positioned.

Joint 350 has a number of bolts 364 which secure the outer race 358 to the front, annular face 367 of a conical member 366 splined to the front end 368 of a propeller drive shaft 370 extending rearwardly to a propeller. A snap ring 372 holds member 366 on shaft 370.

Shaft 370 is rotatably mounted by bearings 374 within a frusto-conical, tubular segment 376 of a propeller shaft carrier 378 having a pivot ball 380 at the forward end thereof. Ball 380 is pivotally mounted in a ball socket 382 at the rear, open end of support casing 252. A number of screws 384 secure a cylindrical segment 386 rearwardly of ball 380 to the front end of segment 376, segment 376 being threaded onto segment 386 and a O-ring seal 388 being between segments 376 and 386.

As shaft 356 is rotated, it rotates inner and outer races 352 and 358 together as a unit, causing member 366 and thereby shaft 370 to rotate at the same speed as shaft 356. If it is desired to pivot the propeller shaft 370 relative to shaft 356, i.e., when ball 380 pivots relative to socket 382, this can be accomplished with steering and trim cylinders of the type shown above with respect to FIGS. 2 and 5. As propeller shaft 370 is pivoted, outer race 358 continues to rotate with inner race 352 notwithstanding the fact that propeller shaft 370 is pivoted out of longitudinal alignment with shaft 356. Also, the speed of rotation of propeller shaft 370 remains substantially the same as that of drive shaft 356; thus, joint 350 provides a constant velocity relationship between the two shafts.

Socket 382 is an improvement over sockets 24 and 258 of FIGS. 1–10 and 13 and includes a first ring 390 of a suitable material, such as nylon. Ring 390 has a spherically configured inner surface 392 in sealing and rolling relationship to the outer surface of ball 380. Ring 390 bears against an annular shoulder 394 on tubular support casing 391 secured to the transom of a boat. An O-ring seal 396 is at the rear end of ring 390 and also is in sealing relationship to the outer surface of ball 380.

A second sealing ring 398 is threadably connected to the inner surface of casing 391 at the rear open end thereof as shown in FIG. 22. Ring 398 is shown in more detail in FIGS. 23–25 wherein the ring 398 has external threads 400 and a plurality of circumferentially spaced, rigid tabs 402 at the outer end thereof. These tabs are for use in rotating ring 298 with a spanner wrench or other tool. Thus, ring 398 can be tightened in place to any desired torque. The ring can then be adjusted for wear and other changes to assure a proper seal yet allow ball 380 to pivot uninterruptedly relative to socket 382.

FIG. 26 showed a marine outdrive apparatus 420 made in accordance with the teachings of the present invention. Apparatus 420 is adapted to be coupled to a drive shaft 422 of an inboard motor (not shown) carried in boat 424 having a transom 426. The steering and trim cylinders are omitted from apparatus 420 in FIG. 26 for purposes of simplifying the drawing; however, it is to be understood that trim cylinders of the type shown in FIGS. 1–10 and 13 are used with apparatus 420 to pivot the propeller shaft carrier 428 laterally and up and down about steering and trim axes. The steering axis can be vertical or inclined as described above with respect to FIGS. 1–10 and FIG. 13.

Drive shaft 422 is offset from the propeller drive shaft in propeller shaft carrier 428, and a transmission unit 430 is secured to the rear face of transom 426 for interconnecting drive shaft 422 with a shaft 432 (FIG. 27) which, in turn, is coupled by a universal joint (not shown in FIG. 27) to the propeller shaft in propeller shaft carrier 428.

A chain drive assembly 434 (FIG. 27) is used in transmission 430 for interconnecting shafts 422 and 432. Chains 436 are coupled with upper sprockets 438 on shaft 422 and lower sprockets 440 on shaft 432. Thus, as shaft 422 is rotated by the motor, shaft 432 is correspondingly rotated to cause rotation of the propeller drive shaft.

A cover 442 is removably mounted on a support 444 secured to the transom 426. Cover 442 protects the interior of transmission 430 and suitable seals (not shown) are provided to assure that no water will leak into the interior of the transmission. Also, a tubular support casing 448 is secured to transmission unit 430 to provide a ball socket at the rear end of casing 448 for pivotally receiving a ball 450 (FIG. 26).

Shaft 422 can be in the same vertical plane as shaft 432 or be in a vertical plane laterally offset from shaft 432.

FIG. 28 shows how the drive shaft 422 can be offset laterally and above as shaft 432 and transmission 430 can still be used to interconnect the shafts. Plate 449 (FIG. 28) represents the attachment point for the upper end of the trim cylinder on transom 446, and plate 450 represents the attachment point for the corresponding steering cylinder. Particularly, the configuration shown in FIG. 28 is used with a pair of drives as shown in FIG. 11 although it could be used with a single drive if desired.

FIG. 29 shows the way in which a pair of inboard motors 460 and 462 can be coupled to the drive apparatus of the present invention, such as apparatus 250. To this end, the output drive shafts 464 and 466 of motors 460 and 462 are coupled by universal joints 468 and 470 to respective shafts 472 and 474. A transmission 476 which is similar in substantially all respects to transmission 430 (FIGS. 26 and 27) is used with the system of FIG. 29. A chain drive assembly 478 in transmission 476 couples shaft 474 with shaft 472 and shaft 472 corresponds to shaft 432 for transmission 430. Thus, shaft 472, coupled through a universal joint 480 to a propeller drive shaft 482 can be driven either by one motor or by both motors 460 and 462 to provide output power for the marine outdrive apparatus of FIG. 29.

What is claimed is:

1. Marine outdrive apparatus for a boat having an inboard engine and a transom comprising: a support casing adapted to extend rearwardly from the transom; means on the rear end of the support casing for forming a ball-receiving socket; a propeller shaft carrier having a forward end and a rear end and provided with a hollow pivot ball mounted thereon at the forward end thereof, said ball being directly mounted within said socket and universally movable about a pivot point relative to the socket; a rotatable drive shaft in said support casing and adapted to be connected to said inboard engine; a propeller shaft journalled in said propeller shaft carrier; universal joint means interconnecting the drive shaft and the propeller shaft at a location within the ball, the center of said universal joint means substantially coinciding with the pivot point of the ball, whereby the propeller shaft carrier and the propeller shaft can pivot laterally about a steering axis and up and down about a trim axis; a propeller mounted on the rear end of the propeller shaft for rotation therewith; and means coupled with the propeller shaft carrier for pivoting the same about the steering axis and about the trim axis.

2. Marine outdrive apparatus as set forth in claim 1, wherein said steering axis is generally vertical.

3. Marine outdrive apparatus as set forth in claim 1, wherein the steering axis is inclined upwardly and forwardly.

4. Marine outdrive apparatus as set forth in claim 3, wherein is included a stabilizing fin secured to and extending downwardly from the propeller shaft carrier.

5. Marine outdrive apparatus as set forth in claim 4, wherein is included trim fin means secured to the stabilizing fin for exerting a downward force thereon as a function of the movement of the trim fin means through the water.

6. Marine outdrive apparatus as set forth in claim 5, wherein the trim fin means is adjustably mounted on the stabilizing fin.

7. Marine outdrive apparatus as set forth in claim 5, wherein said trim fin means extends laterally from opposed sides of the stabilizing fin.

8. Marine outdrive apparatus as set forth in claim 1, wherein said means for pivoting the propeller shaft carrier relative to the support casing includes a first fluid actuated piston and cylinder assembly for pivoting the propeller shaft carrier about the steering axis, and a second fluid actuated piston and cylinder assembly for pivoting the propeller shaft carrier about said trim axis.

9. Marine outdrive apparatus as set forth in claim 8, wherein the first piston and cylinder assembly is pivotally coupled at one end thereof to the propeller shaft carrier and has means thereon at the other end thereof for pivotally coupling the same to the transom of a boat.

10. Marine outdrive apparatus as set forth in claim 9, wherein said pivot point of the coupling means at the other end of the first piston and cylinder assembly is generally vertically aligned with the pivot point of said ball.

11. Marine outdrive apparatus as set forth in claim 9, wherein the pivot point of the coupling means at the other end of the first piston and cylinder assembly is forwardly and above the pivot point of the ball, whereby the steering axis is generally inclined upwardly and forwardly.

12. Marine outdrive apparatus as set forth in claim 8, wherein the second piston and cylinder assembly has a rear end pivotally coupled to a respective side of the propeller shaft carrier and a mounting means for pivotally coupling the forward end of the second piston cylinder assembly near the transom, the trim axis passing through the pivot point of the ball and the pivot point of the mounting means at the forward end of the second piston and cylinder assembly.

13. Marine outdrive apparatus as set forth in claim 12, wherein the mounting means at the forward end of the second piston and cylinder assembly is secured to and extends laterally from one side of the support casing.

14. Marine outdrive apparatus as set forth in claim 12, wherein the mounting means at the forward end of the second piston and cylinder assembly is adapted to be secured to the transom of a boat.

15. Marine outdrive apparatus as set forth in claim 1, wherein said propeller shaft carrier has a substantially conical outer surface which reduces in cross-section as the rear end of the propeller shaft is approached.

16. Marine outdrive apparatus as set forth in claim 1, wherein said ball socket is in sealing, pivotal engagement with the outer surface of the ball, there being means near the forward end of the support casing for sealing the junction between the support casing and said drive shaft so that the interior of the ball containing the universal joint means is a closed space which may contain a fluid.

17. Marine outdrive apparatus as set forth in claim 1, wherein said propeller shaft carrier has sealing means at a pair of spaced locations thereon to present a closed space in the carrier which may contain a flowable lubricant.

18. Marine outdrive apparatus as set forth in claim 1, wherein is included a stabilizing fin secured to and extending downwardly from the propeller shaft carrier.

19. Marine outdrive apparatus as set forth in claim 18, wherein the stabilizing fin has a leading edge which tends outwardly and rearwardly of the propeller shaft carrier as the outer end of the fin are approached.

20. Marine outdrive apparatus as set forth in claim 18, wherein is included a second fin rigidly secured to and extending upwardly from the propeller shaft carrier, and a cavitation plate secured to the upper end of the second fin, said cavitation plate extending rearwardly of the second fin in substantially overlying relationship to the propeller.

21. Marine outdrive apparatus as set forth in claim 18, wherein is included trim fin means secured to the stabilizing fin for exerting a downward force thereon as a function of the movement of the trim fin, means through the water.

22. Marine outdrive apparatus as set forth in claim 21, wherein said trim fin means is adjustably mounted on the stabilizing fin.

23. Marine outdrive apparatus as set forth in claim 21, wherein said trim fin means extends laterally from opposed sides of the stabilizing fin.

24. Marine outdrive apparatus as set forth in claim 21, wherein said trim fin means comprises a pair of trim fins for respective, opposed sides of the stabilizing fin, and means coupled with the trim fins for adjustably mounting the same on a lower end of the stabilizing fin so that the angle of attack of the trim fins can be changed.

25. A marine outdrive apparatus as set forth in claim 24, wherein the bottom surface of each trim fin has a curvature greater than the upper surface thereof.

26. A marine outdrive apparatus as set forth in claim 21, wherein said said trim fin means comprises a trim fin of one piece construction, and means coupling the trim fin to the lower end margin of the stabilizing fin so that opposed side portions of the trim fin extend laterally from respective sides of the stabilizing fin.

27. Marine outdrive apparatus as set forth in claim 26, wherein is included means adjustably mounting the trim fin on the stabilizing fin.

28. Marine outdrive apparatus as set forth in claim 1, wherein said universal joint means comprises a universal joint of the constant velocity type.

29. Marine outdrive apparatus as set forth in claim 28, wherein said universal joint comprises an inner race secured to the drive shaft and rotatable therewith, an outer race secured to the propeller drive shaft and rotatable therewith, and ball bearing means interconnecting the inner and outer races to permit the races to rotate as a unit about the axis of the drive shaft and to permit the outer race to pivot universally relative to the inner race.

30. Marine outdrive apparatus as set forth in claim 1, wherein is included a second drive shaft coupled to the motor and spaced above the first-mentioned drive shaft in the support casing, and including a transmission unit secured to the support casing and connecting the second drive shaft with the first drive shaft.

31. Marine outdrive apparatus as set forth in claim 30 wherein said transmission unit includes a chain and sprocket assembly.

32. Marine outdrive apparatus as set forth in claim 30 wherein the second drive shaft is in a vertical plane laterally spaced from the vertical plane of the first drive shaft, said transmission unit being inclined.

33. Marine outdrive apparatus as set forth in claim 30 wherein is included a pair of inboard motors, one of the motors being coupled directly to the first drive shaft, the other inboard motor being directly coupled to the second drive shaft, whereby the propeller drive shaft can be driven by one or both inboard motors.

34. Marine outdrive apparatus attachable to a boat having a fore and aft axis and an inboard engine, said apparatus comprising:

a support casing securable to said boat;

a socket supported by said support casing;

a propeller shaft carrier having a forward portion formed with a hollow ball that is pivotally carried by and directly mounted within said socket to form a ball and socket joint having a pivot point;

a drive shaft adapted for connection to said engine;

a propeller shaft rotatably supported by said propeller shaft carrier, said propeller shaft receiving a propeller;

universal joint means interconnecting said drive shaft and said propeller shaft, the center of the universal joint means coinciding with the pivot point of the ball and socket joint;

said propeller shaft carrier being swingable laterally and vertically relative to said fore and aft axis of the boat for steering the boat;

and means for swinging said propeller shaft carrier relative to the support casing.

35. Marine outdrive apparatus as set forth in claim 34, wherein is included a stabilizing fin secured to and extending downwardly from the propeller drive shaft.

36. Marine outdrive apparatus as set forth in claim 35, wherein is included trim fin means on the stabilizing fin for exerting a downward force thereon as a function of the movement of the trim fin means through the water.

37. Marine outdrive apparatus as set forth in claim 36, wherein the trim fin means is adjustably mounted on the stabilizing fin.

38. Marine outdrive apparatus as set forth in claim 36, wherein the trim fin means extends laterally from opposed sides of the stabilizing fin.

39. Marine outdrive apparatus as set forth in claim 34, wherein said propeller drive shaft is movable downwardly as it swings laterally relative to said fore and aft axis.

40. Marine outdrive apparatus as set forth in claim 39, wherein said propeller shaft carrier is swingable about an axis transverse to the fore and aft axis of the boat to raise and lower the propeller, said transverse axis extending through said pivot point for trimming the boat.

41. Marine outdrive apparatus as set forth in claim 39, wherein is included a stabilizing fin secured to and extending downwardly from the propeller drive shaft.

42. Marine outdrive apparatus as set forth in claim 41, wherein is included trim fin means on the stabilizing fin for exerting a downward force thereon as a function of the movement of the trim fin means through the water.

43. Marine outdrive apparatus as set forth in claim 42. wherein the trim fin means is adjustably mounted on the stabilizing fin.

44. Marine outdrive apparatus as set forth in claim 42, wherein the trim fin means extends laterally from opposed sides of the stabilizing fin.

45. Marine outdrive apparatus as set forth in claim 34 wherein said propeller shaft carrier is swingable about an axis transverse to the fore and aft axis of the boat to raise and lower the propeller, said transverse axis extending through said pivot point for trimming the boat.

46. Marine outdrive apparatus for a boat having inboard engine means and a transom comprising: a pair of outdrive devices, each device including a support casing adapted to extend rearwardly from the transom, means on the rear end of each support casing for forming a ball-receiving socket, a propeller shaft carrier having a forward end and a rear end and provided with a hollow pivot ball mounted thereon at the forward end thereof, said ball being directly mounted within said socket of the corresponding support casing and universally movable about a pivot point relative to its socket, a rotatable drive shaft in each support casing and adapted to be connected to said inboard engine means, a propeller shaft journalled in each propeller shaft carrier, respectively, universal joint means interconnecting the drive shaft and the propeller shaft of each device at a location within the respective ball, the center of each universal joint means substantially coinciding with the pivot point of the respective ball, whereby each propeller shaft carrier and its propeller shaft can pivot laterally about a steering axis and up and down about a trim axis, a propeller mounted on the rear end of the propeller shaft of each device for rotation therewith, and means coupled with the propeller shaft carriers of said devices for pivoting the propeller shaft carriers about the steering axis and about the trim axis.

47. Marine outdrive apparatus as set forth in claim 46, wherein said steering axis is generally vertical.

48. Marine outdrive apparatus as set forth in claim 46, wherein the steering axis is inclined upwardly and forwardly.

49. Marine outdrive apparatus for a boat having an inboard engine and a transom comprising: a support casing member adapted to extend rearwardly from the transom; a propeller shaft carrier member having a forward end and a rear end; a ball and socket unit pivotally connecting the rear end of the casing member to the forward end of the carrier member, one of the members having means thereon for defining the socket of said unit and the other member having means defining the ball of said unit, said ball being hollow, said ball further being directly mounted within said socket and universally movable about a pivot point relative to the socket; a rotatable drive shaft in said support casing member and adapted to be connected to said inboard engine; a propeller shaft journalled in said propeller shaft carrier member; universal joint means interconnecting the drive shaft and the propeller shaft at a location within the ball, the center of said universal joint means substantially coinciding with the pivot point of the ball, whereby the propeller shaft carrier member and the propeller shaft can pivot laterally about a steering axis and up and down about a trim axis; a propeller mounted on the rear end of the propeller shaft for rotation therewith; and means coupled with the propeller shaft carrier member for pivoting the same about the steering axis and about the trim axis.

* * * * *

Disclaimer 4,645,463.—*Howard M. Arneson,* San Rafael, Calif. MARINE OUTDRIVE APPARATUS. Patent dated Feb. 24, 1987. Disclaimer filed Apr. 9, 1990, by the inventor.

The term of this patent subsequent to Oct. 1, 2002, has been disclaimed.

[ *Official Gazette June 26, 1990* ]